United States Patent [19]

Bailen

[11] 4,146,153

[45] Mar. 27, 1979

[54] STERILE DISPENSING DEVICE

[75] Inventor: William J. Bailen, Milwaukee, Wis.

[73] Assignee: Knight Development Corporation, Milwaukee, Wis.

[21] Appl. No.: 813,655

[22] Filed: Jul. 7, 1977

[51] Int. Cl.[2] ..... B67B 7/24

[52] U.S. Cl. ..... 222/83; 222/91

[58] Field of Search ..... 222/81, 83, 83.5, 85, 222/86, 87, 88, 89, 90, 91; 128/215, 216, 272, 272.1, 272.2; 141/2, 3, 18

[56] References Cited

U.S. PATENT DOCUMENTS

| | | | |
|---|---|---|---|
| 3,158,155 | 11/1964 | Myerson et al. | 128/272 X |
| 3,171,412 | 3/1965 | Braun | 128/272 |
| 3,736,932 | 6/1973 | Satchell | 128/215 |
| 3,889,673 | 6/1975 | Dovey et al. | 128/215 |
| 3,977,555 | 8/1976 | Larson | 128/272 |
| 4,018,222 | 4/1977 | McAleer | 128/216 |

*Primary Examiner*—Allen N. Knowles
*Attorney, Agent, or Firm*—James E. Nilles

[57] ABSTRACT

There is disclosed a sterile dispensing device in which sterile material in liquid or powdered form is supplied and from which the material can be transferred, as in a laboratory or hospital, to another sealed sterile container such as a bottle or flexible plastic bag. The device comprises a flexible plastic container for containing the material and having a sealed neck and a hollow cylindrical adapter mounted on the neck and having a hollow spike and hollow needle therewithin which are in communication with each other. Means, such as external threads on the container neck and engaged with internal threads in one end of the adapter, enable the adapter to be rotated and thereby moved from one position to another operative position wherein the spike pierces the container neck seal and enables the material to be transferred through the spike and the needle, as when the needle is inserted into the aforesaid other sealed container. The adapter, which is provided with a removable protective cover at one end and which has a built-in filter, is maintained in the aforesaid position prior to use by means of a removable sealing member which secures it to the container.

7 Claims, 12 Drawing Figures

STERILE DISPENSING DEVICE

BACKGROUND OF THE INVENTION

1. Field of Use

This invention relates generally to dispensing device containing sterile material in liquid or powdered form which is to be transferred to another container.

2. Description of the Prior Art

In hospitals, pharmacies, and laboratories, it is often necessary to transfer sterile material in liquid or powdered (such as water, medication, drugs or the like) form from containers such as a vial or bottle furnished by a supplier, to another container while maintaining absolute sterility conditions during the transfer. For example, sterile liquid materials are sometimes supplied in a sealed vial and the needle of a hypodermic syringe or similar device is inserted through the seal, the required amount of liquid is withdrawn into the syringe, and then injected into another sealed container such as a flexible minibag which is used in connection with intravenous administration of liquid. In the case where powdered material are supplied in the vial, the hypodermic syringe is used to inject a liquid diluent, such as sterile water, into the vial to dissolve the material and to then use the syringe to withdraw the diluted mixture from the vial for subsequent injection into the other container. In either case, use of a hypodermic syringe or similar device to effect the transfer increases the risk of contamination of the material. To avoid this problem and reduce the risk of contamination, some vials in which the material is furnished are constructed to enable the material to be transferred directly to the other container. Or, a sterile disposable device is furnished which is insertable through the seal of the vial and adapts it for direct connection to the other container to enable transfer of the material. The following U.S. Patents show the state of the art, U.S. Pat. Nos. 2,957,609, 2,957,501, 2,761,833, 2,724,383, 2,693,418, 2,594,161, 2,143,661, 1,455,047, 1,154,269, 489,620.

SUMMARY OF THE PRESENT INVENTION

In accordance with the invention, there is provided a sterile dispensing device in which sterile material in liquid or powdered form is supplied and from which the material can be transferred, as in a laboratory or hospital, to another sealed sterile container such as a bottle or flexible plastic bag. The device comprises a flexible plastic container for containing the material and having a sealed neck and a hollow cylindrical adapter mounted on the neck and having a hollow spike and hollow needle therewithin which are in communication with each other. Means, such as external threads on the container neck and engaged with internal threads in one end of the adapter, enable the adapter to be rotated and thereby moved from one position to another operative position wherein the spike pierces the container neck seal and enables the material to be transferred through the spike and the needle, as when the needle is inserted into the aforesaid other sealed container. The adapter, which is provided with a removable protective cover at one end and which has a built-in filter, is maintained in the aforesaid position prior to use by means of a removable sealing member which secures it to the container.

A dispensing device in accordance with the present invention offers several advantages over the prior art. For example, the dispensing device includes all of the means necessary for transfer of the material therein to another container and no additional sterile disposable component for use therewithin needs to be purchased, stored, located, and used. Furthermore, the seal in the dispensing device remains unbroken until a positive action is carried out by the user. Furthermore, the seal on the dispensing device and the seal piercing portion of the needle are initially sterile and always protected against being touched by human hands or other objects. Similarly, the outwardly projecting portion of the needle for insertion into the other container is sterile and protected against contamination by a removable protective cover which remains in place while the piercing of the vial takes place and until the last moment before transfer is carried out, thereby greatly reducing the risk of contamination. A dispensing device in accordance with the invention is economical to manufacture, self-contained, reliable in use, and foolproof in operation. Other objects and advantages will hereinafter appear.

DESCRIPTION OF A PREFERRED EMBODIMENT

Figure 1:
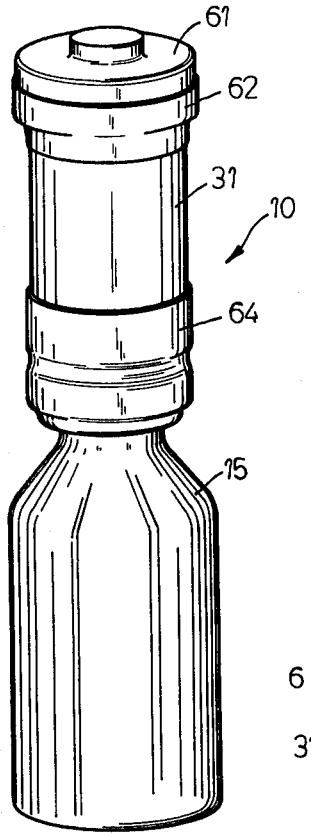
FIG. 1 is a perspective view of a dispensing device in accordance with the invention and showing the adapter thereof in its initial seal-intact position.
Figure 2:
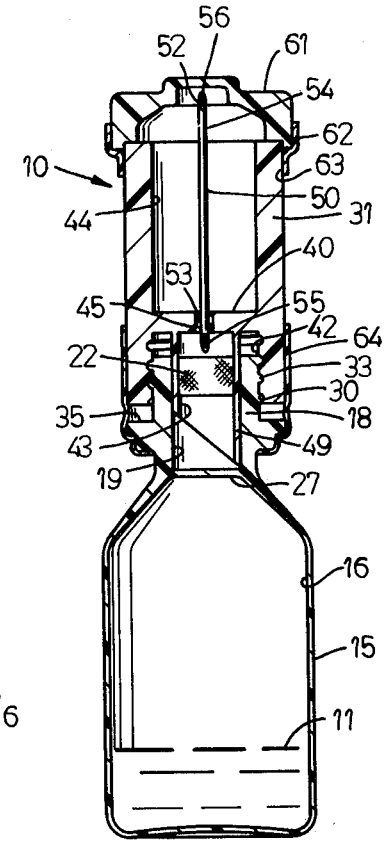
FIG. 2 is a cross-section view of the device as shown in FIG. 1.
Figure 8:
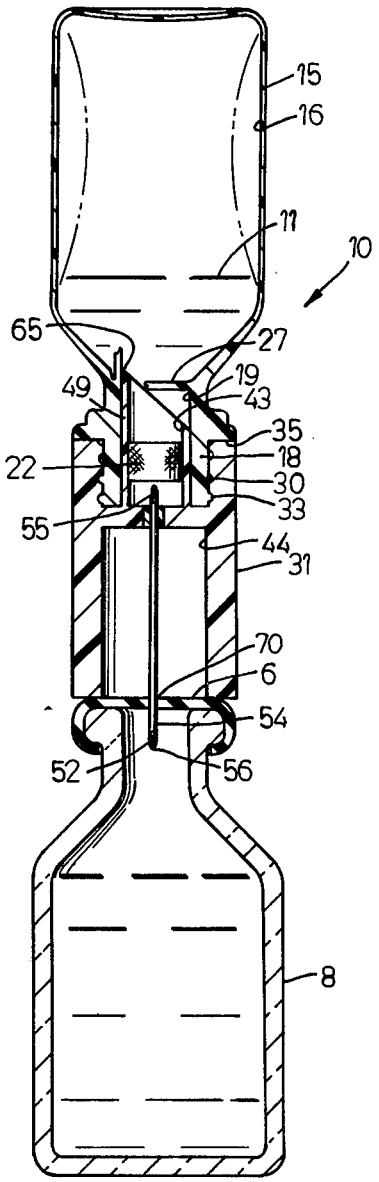
FIGS. 8 and 9 are views similar to FIG. 7 but showing the device up-ended and with its outwardly projecting needle inserted through a seal and into the mouth of associated containers.
Figure 9:
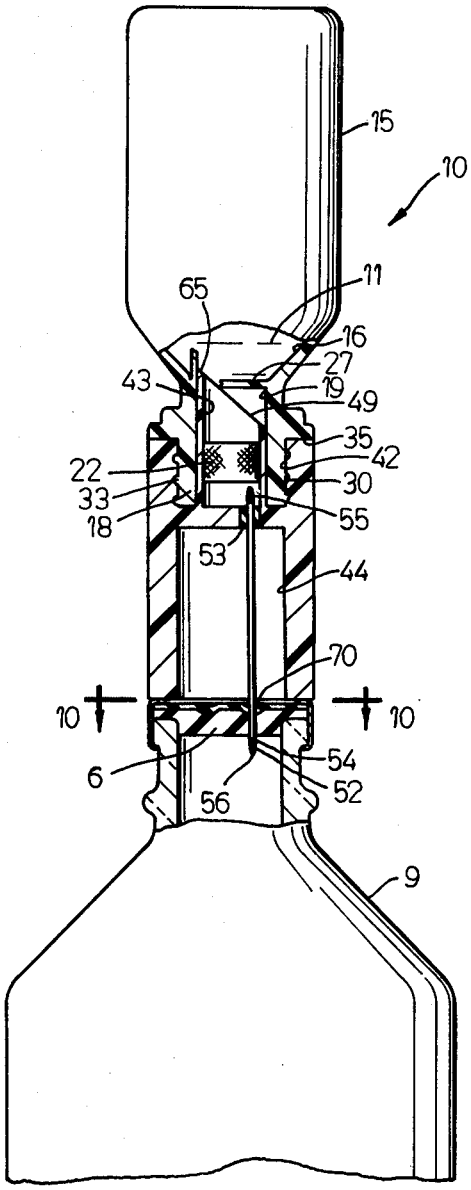
Figure 10:
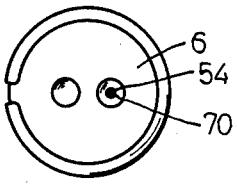
FIG. 10 is a section view of the bottle and needle taken on line 10—10 of FIG. 9.
Figure 11:
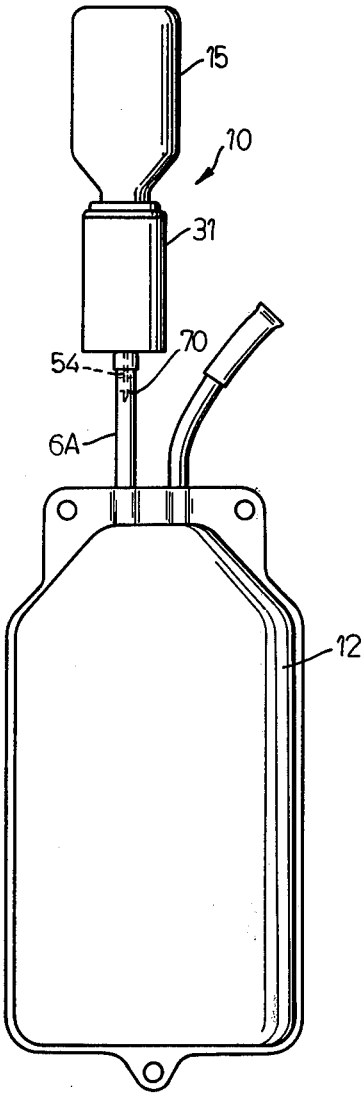
FIG. 11 is a side elevation view of the device up-ended and with its needle inserted into the filler or medication port of a flexible bag.

Referring to FIGS. 1 and 2, the numeral 10 designates a dispensing device in accordance with the invention and which contains a sterile material 11, in either liquid or powdered form, which is to be transferred to another container, such as the bottles 8 and 9, shown in FIGS. 8 and 9, respectively, or the flexible bag 12 shown in FIG. 11. It is to be understood that device 10 is furnished by a supplier or manufacturer and filled with an appropriate material 11 and in the physical condition shown in FIGS. 1 and 2 for use by personnel in hospitals, pharmacies, or laboratories and that the material 11 in the container and all non-exposed component parts and surfaces thereof are sterile. Each bottle 8, 9, and 12 is provided with a pierceable seal 6.

The device 10 generally comprises a flexible plastic container 15 for containing the material 11 and having a neck 18 having a seal 27 therein and a hollow cylindrical adapter 31 mounted on the neck and having a hollow spike 49 and hollow needle 50 therewithin which are in communication with each other. Means, such as external threads 33 on the container neck 18 and engaged with internal threads 30 in one end of the adapter 31, enable the adapter to be rotated and thereby moved from one position, shown in FIG. 2, to another operative position, shown in FIG. 7, wherein the spike 49 pierces the container neck seal 27 and enables the material 11 to be transferred through the spike 49 and the needle 50, as when the needle is inserted into the other sealed containers, such as 8, 9, and 12. The adapter 31, which is provided with a removable protective cover 61 at one end and which has a built-in filter 22, is maintained in the position shown in FIG. 2 prior to use by means of a removable sealing member which secures it to the container 15.

As stated, device 10 comprises a flexible plastic container 15 having a chamber 16 therein for receiving the material 11 and an integrally formed neck portion 18 having a neck passage 19 therethrough for communicating with chamber 16 when seal 27 is pierced and through which the container is filled during manufacture prior to installation of seal 27. Container 15 is fabricated of flexible plastic material, such as polyethylene, polyolefin, or the like, so that it can be squeezed to expel the material 11 therefrom, as hereinafter described and will return to its original shape so as to draw material back into the chamber 16 thereof, if necessary, during certain procedures.

The neck passage 19 is provided with a sealing member 27 which is put and secured in place after container 15 is filled. Sealing member 27 is conventional in form and is secured in place in a conventional manner and could be fabricated of rubber or plastic or any other material which is compatible with the material 11 and can be pierced by a sharp needle.

Figure 3:
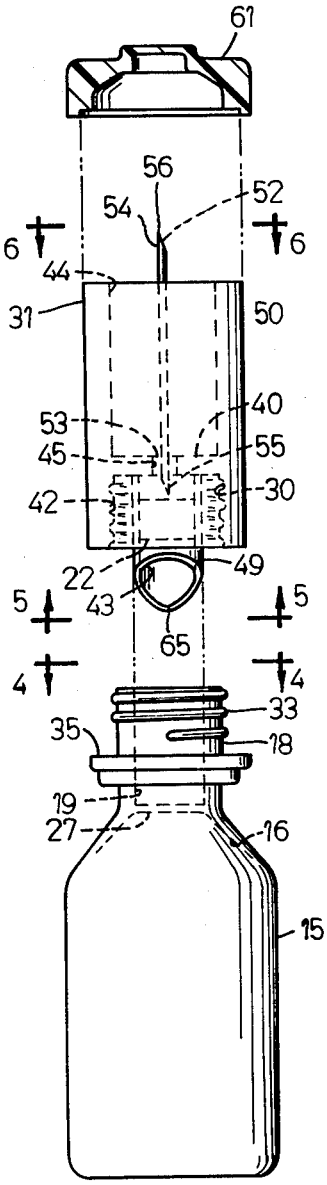
FIG. 3 is a cross-sectional view of the device of FIG. 1 with the flexible container and adapter separated.
Figure 4:
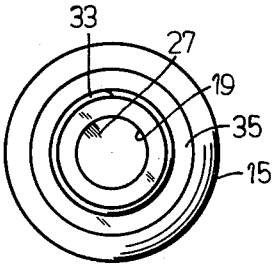
FIG. 4 is a top plan view of the container neck taken on line 4—4 of FIG. 5.
Figure 6:
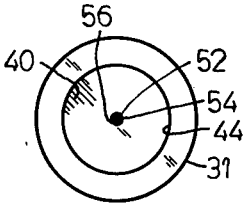
FIG. 6 is a top plan view of the adapter taken on line 6—6 of FIG. 3.
Figure 5:
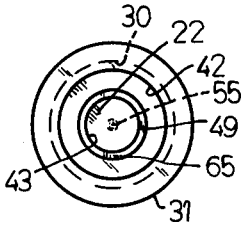
FIG. 5 is a bottom plan view of the adapter taken on line 5—5 of FIG. 3.
Figure 7:
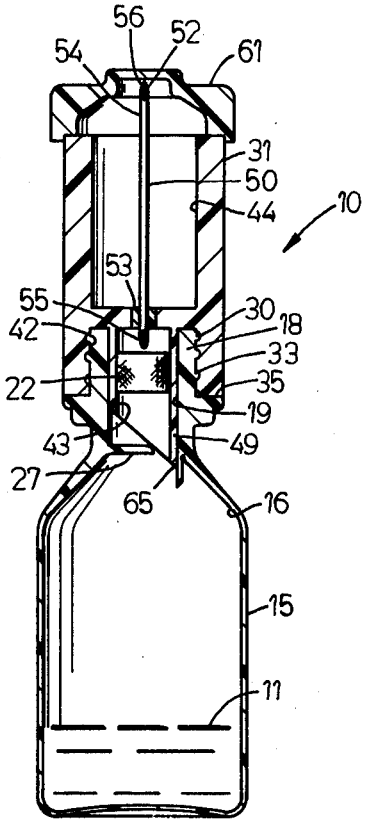
FIG. 7 is a view similar to FIG. 2 but showing the adapter after it has been moved to its subsequent seal-piercing position.

As FIGS. 2, 3, and 7 show, the neck portion 18 of container 15 is provided on its exterior surface with means for releasable engagement with adapter 31, which means initially maintain the cap member in the position shown in FIG. 2 and enable the cap member to be moved manually, when required, to the position shown in FIG. 7. The said means take the form of the threads 33 which are integrally formed with neck portion 18, are of semicircular cross-sectional configuration, and extend around the periphery of the exterior surface of neck portion 18. Threads 33 are located sufficiently far away from the upper or integral shoulder portion 35 of container 15 so as to enable the adapter 31 to be moved downwardly without interference to the position shown in FIG. 7 when it is rotated.

As FIGS. 1, 2, and 3 show, adapter 31, which is also preferably formed of plastic of the aforedescribed character, is a hollow cylindrical member having a divider wall 40 therewithin. The top portion of adapter 31 is provided with an upper central opening or chamber 44 within which hollow needle 50 is rigidly mounted in sealed relationship to and extending through the divider wall 40. The lower portion of adapter 31 is provided with a lower central opening or chamber 42 and adapter 31 is provided with means, such as the circumferential internal threads 30, for cooperative engagement with the threads 33 on neck portion 18 of container 15 to initially maintain the cap member in the position shown in FIGS. 1 and 2 and enable subsequent movement, as by rotation of adapter 31 relative to container 15, to the position shown in FIG. 7. The threads 30 are sized, shaped, and proportioned with respect to the threads 33 so that the adapter 31 will remain in the position shown in FIG. 2, until sufficient rotational force is exerted on adapter 31 to cause downward movement.

As FIGS. 2 and 3 best show, the hollow needle 50, which is preferably fabricated of stainless steel or the like, has a continuous unobstructed passage 52, open at both ends, extending axially therethrough. Needle 50 is provided on its exterior and intermediate its ends with an integrally formed boss or hub 53 by means of which it is rigidly secured and sealed in an opening 45 of divider wall 40. Needle 50 includes an upper or outer portion 54 which extends outwardly from chamber 44 and a lower or inner portion 55 which extends coaxially within the chamber 43 inside spike 49.

Outer portion 54 of needle 50 is sharpened as at 56 to provide a point which is adapted to pierce the seals in filler ports of the containers 8, 9, and 12, as FIGS. 8, 9, and 11 show. Needle portion 54 is initially protected against contamination and mechanical damage by a removable hollow cover 61, open at one end, which fits over needle portion 54 and is releasably secured to the upper end of adapter 31. Cover 61 is secured as by removable attachment and sealing means 62. The attachment means 62, which could take any suitable form, are shown as comprising a relatively thin tear-away or breakaway member which is integral with cover 61 and heat-sealed as at 63 to adapter 31. Adapter 31 is secured in the position shown in FIG. 2 by a seal and attachment means 64 similar to seal 62 aforedescribed.

Spike 49 is sharpened as at 65 to provide a point which is adapted to pierce and extend through the seal 27 in the neck 18 of container 15 when adapter 31 is rotated and moved from the position shown in FIG. 2 to the position shown in FIG. 7. The length of spike 49 is such, relative to the location of seal 27, that its point is initially spaced from seal 27 (see FIG. 2) but pierces and extends through seal 27 (see FIG. 7). Furthermore, downward travel of spike 49 beyond the position shown in FIG. 7 is prevented by the engagement of the lower edge of adapter 31 with shoulder 35 of container 15.

The passage 43 in spike 49 is provided intermediate its ends with a filter member 22 frictionally or otherwise secured therein during manufacture. Filter member 22 could take a form other than that shown and could be secured in position by any suitable means.

Operation

The device 10 is employed in the following manner. Assume that the device 10 is furnished filled with material 11 and is initially in the condition shown in FIGS. 1 and 2. When the device 10 is ready to be used so as to inject the material 11 therein into some other container, the seal 64 is removed and the user grasps the adapter 31 and rotates it to move it downwardly to the position shown in FIG. 7. Downward movement of adapter 31 is accompanied by downward movement of spike 49 which pierces the seal 27 in the neck passage 18 in container 15. At this point, passage 52 in needle 50 is in communication through passage 43 in spike 49 with chamber 16 in container 15. When the user is ready to inject the material 11 into the containers 8, 9, or 12, the tear-away strip 62 is peeled or torn away and the protective cover 61 is removed from adapter 31 and may be discarded. As FIGS. 8, 9, and 11 show, needle portion 54 is inserted through the seal and into filler port 70 of the containers 8, 9, or 11. After this is done, the user squeezes flexible container 15 to cause the material 11 to be injected into the associated containers 8, 9, or 11 and all or part of the material 11 may be injected into the container. When the desired amount of material 11 has been injected, the needle portion 54 is withdrawn and the device 10, if empty, may be discarded. If there is material 11 remaining in device 10 that is still usable, the protective cover 61 may be replaced over needle portion 54 to prevent it from becoming contaminated.

The above-described series of steps would be employed in the case where the material 11 was a liquid. If, however, the material 11 in device 10 is a powder, it is necessary to introduce a diluent into chamber 16 of the device 10. This is accomplished by following the above procedure until the device is in the condition shown in FIG. 7, whereupon the cap 61 is removed and the needle portion 54 is inserted into a container, such as 8 shown in FIG. 8, for example, wherein the necessary diluent in liquid form is contained. In this case, it is necessary that the container 15 be squeezed, as shown in phantom lines in FIG. 8, so as to expel air entrapped within container 15. Then, assuming that the passage 52 in needle 50 is in communication with the liquid in container 8 (up-ending of bottle 8 being necessary), the squeezing pressure on container 15 is relieved and the liquid is drawn inwardly through passage 52 in needle 50, through filter 22, through spike 49 into the chamber 16 in container 15. When a sufficient quantity of diluent has been drawn into the device 10, the needle portion 54 is withdrawn from the container 8 which contains the diluent. At this point, if necessary, the device 10 may be shaken to mix the material 11 with the diluent. The needle portion 54 of the device 10 is now ready to be inserted into the same container, such as 8, which contained the diluent or into some other container, such as 9 or 12, and squeezed so as to expel the mixed solution therefrom. In the embodiment shown, the filter 22 serves to prevent passage of undissolved crystals or particles of material 11 from chamber 16 of container 15. This filtering feature is especially important, for example, in instances where the material 11 in device 10 takes the form of a soluble antibiotic which has insoluble particles therein (formed during manufacturing of the antibiotic) which could be damaging to the system of a person into whom the solution formed in device 10 is ultimately injected.

As is apparent from all of the foregoing, the construction of device 10 is such that no portion of needle 50 is ever exposed to possible contamination until the protective cover 61 is removed and then needle portion 54 can only be contaminated by improper handling. The neck portion 18 of device 10, the inside of adapter 31, the inner needle portion 53, the seal member 27 in device 10, the neck passage 19, the spike 49, and the filter 22 are always totally enclosed before and during the time the device 10 is in use. Another significant advantage of the device 10 is the fact that the needle 50 and spike 49 and the adapter 31 which effects movement of the spike between its seal piercing position and initial position are an integral part of the device and cannot be misplaced or contaminated during normal handling. Furthermore, the engagement means or threads 33 and 30 on the container 15 and the adapter 31 are constructed and arranged so that inadvertent piercing of the seal by downward movement of needle portion 54 cannot be easily effected accidentally but requires a positive application of rotational force by the user. Furthermore, the engagement means prevent inadvertent withdrawal of the needle portion 54 from the container seals 6 which would interrupt the flow of the material 11 during use.

Figure 12:
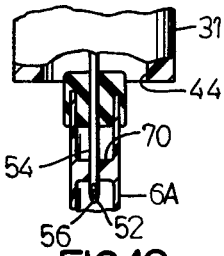
FIG. 12 is an enlarged cross-section view of the medication port shown in FIG. 11.

As FIG. 3 shows, the end portion 54 of needle 50 projects beyond the upper end of adapter 31 when cap 61 is removed. Thus, the device 10 can be used with bottles such as 8 and 9 shown in FIGS. 8 and 9, respectively, wherein the seal 6 is located at the very top end of the bottle. Furthermore, as FIGS. 8 and 9 show, the adapter 31 enables the device 10 to rest on bottles, such as 8 and 9, the device 10 being further steadied by the engagement of the needle 50 with the seal 6 on the bottles 8 and 9. On the other hand, as FIG. 11 shows, the chamber 44 in adapter 31 enables the filler tube 6A (shown in FIGS. 11 and 12) of a plastic bag 12 to be inserted within the chamber 44 thereby enabling needle 50 to penetrate seals which are some distance from the end of a filler tube such as 6A.

It is to be understood that the engagement means on the adapter 31 and neck portion 18 of container 15 could take a form other than that shown. Other modifications could also be made to the device disclosed herein without departing from the scope of the appended claims.

I claim:

1. A sterile dispensing device in which sterile material in liquid or powdered form is supplied and from which the material can be transferred to another sealed sterile container such as a bottle or flexible plastic bag, comprising:

a flexible container for containing said material, said flexible container having a neck with a neck passage therethrough, said neck having external screw threads thereon;

sealing means on said flexible container for closing said neck passage;

a hollow adapter mounted on said flexible container, said adapter having a hollow spike and hollow needle mounted therewithin which are in communication with each other, said hollow spike being located near one end of said hollow adapter and said hollow needle projecting from the other end of said hollow adapter;

and internal screw threads on said one end of said adapter for engagement with said external screw threads on said neck whereby said hollow adapter is supported on said flexible container and to enable said hollow adapter to be rotatably movable from one position wherein said hollow spike is in non-piercing relationship to said seal and to another operative position wherein said hollow spike pierces said seal and enables said material to flow through said hollow spike and said hollow needle.

2. A device according to claim 1 including a filter mounted on said adapter in the flow path through said spike and needle.

3. A device according to claim 1 including a removable cap for said other end of said hollow adapter.

4. A device according to claim 3 including removable sealing means for securing said cap to said adapter and for securing said adapter to said flexible container in said one position.

5. A device according to claim 1 including interengageable means on said flexible container and said hollow adapter to limit the distance said hollow spike can be moved relative to said seal.

6. A device according to claim 1 wherein said hollow adapter is cylindrical and has a longitudinal axis and wherein said hollow needle is displaced from said axis.

7. A sterile dispensing device in which sterile material in liquid or powdered form is supplied and from which the material can be transferred to another sealed sterile container such as a bottle or flexible plastic bag, comprising:

a flexible container for containing said material, said flexible container having a neck with a neck passage therethrough, said neck having external screw threads thereon;

sealing means on said flexible container for closing said neck passage;

a hollow adapter mounted on said flexible container, said adapter having a hollow spike and hollow needle mounted therewithin which are in communication with each other, said hollow spike being located near one end of said hollow adapter and said hollow needle projecting from the other end of said hollow adapter, said hollow adapter comprising an axial bore therethrough, and further comprising a wall located in said bore, said hollow spike being integrally connected to said wall, and wherein said wall has a hole therethrough wherein said hollow needle is supported in sealed relationship;

and internal screw threads on said one end of said adapter for engagement with said external screw threads on said neck whereby said hollow adapter is supported on said flexible container and to enable said hollow adapter to be rotatably movable from one position wherein said hollow spike is in non-piercing relationship to said seal and to another operative position wherein said hollow spike pierces said seal and enables said material to flow through said hollow spike and said hollow needle.

* * * * *